United States Patent [19]

Wong et al.

[11] 4,065,655

[45] Dec. 27, 1977

[54] MICROWAVE LEAKAGE INDICATOR STRIP

[75] Inventors: James Y. Wong, Ottawa; Satish C. Kashyap, Hazeldean; John G. Dunn, Hammond, all of Canada

[73] Assignee: Canadian Patents and Development Limited, Ottawa, Canada

[21] Appl. No.: 687,237

[22] Filed: May 17, 1976

[51] Int. Cl.[2] ..... H05B 9/06

[52] U.S. Cl. ..... 219/10.55 D; 23/230 LC; 250/483

[58] Field of Search ..... 219/10.55 D, 10.55 C, 219/10.55 R; 174/35 R, 35 GC; 252/408 LC, 299, 68; 350/160 LC; 23/230 LC; 250/472, 484, 483; 73/355 R

[56] References Cited

U.S. PATENT DOCUMENTS

| | | | |
|---|---|---|---|
| 3,802,945 | 4/1974 | James | 252/408 LC |
| 3,804,618 | 4/1974 | Fore st et al. | 254/408 LC |
| 3,826,141 | 7/1974 | Pickett et al. | 252/408 LC |
| 3,919,105 | 11/1975 | Katagiri et al. | 252/408 LC |

*Primary Examiner*—Arthur T. Grimley
*Attorney, Agent, or Firm*—James R. Hughes

[57] ABSTRACT

A microwave leakage indicator for ovens in the form of a strip of encapsulated liquid crystal film backed by a layer of microwave absorbing material mounted around the edge of the door and overlapping the slot between door and oven where leakage might occur. The characteristics of the liquid crystal material are chosen such that if leakage above a preset level does occur at any location around the edge of the door, the absorbing material generates heat resulting in a quickly noticeable colour change in the liquid crystal film.

3 Claims, 7 Drawing Figures

MICROWAVE LEAKAGE INDICATOR STRIP

This invention relates to a microwave leakage indicator strip and more particularly to a simple device for use on microwave oven doors and the like to give a warning of the passage of dangerous radiation to the exterior of the oven.

Microwave ovens are finding greater acceptance for cooking and re-heating foods in home as well as hospitals, restaurants, etc. Better door seals and the introduction of additional features like defrosting and browning elements have been helpful in increasing their popularity. However, the microwave ovens still lack an important feature — that of being able to automatically indicate if the microwave leakage around the oven door exceeds permissible levels. Thus, a person operating the microwave oven has at present no means to detect the presence of microwave leakage. He may, if he suspects it's presence, obtain a radiation monitor and check the oven for leakage. If he does not suspect any leakage, he may be exposed to leakage levels for a long period of time, far higher than those allowed by the standards.

Radiation monitors of various kinds are available in the market to check the leakage level around microwave oven doors as well as industrial equipment. Most of these are quite expensive ($300 - $2,000) and basically use a number of RF detectors (e.g. thermistors) and a meter. One inexpensive version uses a single RF detector diode and a current meter. Examples of radiation detectors for oven doors are described in the following U.S. Pat. Nos.: 3,651,300 issued Mar. 21, 1972, to D. B. Haagenson; 3,679,908 issued July 25, 1972, to L. Mazza; and 3,749,875 issued July 31, 1973, to J. Fitzmayer. These patents are all concerned with electrical apparatus for radiation detection e.g., an antenna positioned around the oven door and feeding into some form of receiver.

A liquid crystal microwave power density meter has also been produced which has a plastic membrane with resistive and liquid crystal coatings which serve as a sensing element. It uses direct current electrical power for bias and calibration of the membrane. Another liquid crystal microwave power density meter measures change in optical reflectance of a liquid crystal layer with temperature. However, all the present microwave power density meters give the leakage at a point and require the monitor probe to be moved all around the oven door for an indication of maximum leakage.

It is an object of the invention to provide a simple microwave leakage indicator strip for oven doors that provides a clear indication if the radiation leakage is higher than some preset permissible level at any position around the periphery of the door.

This and other objects of the invention are achieved by a microwave leakage indicator in the form of a strip of encapsulated liquid crystal film backed by a layer of microwave absorbing material mounted around the edge of the door and overlapping the slot between door and oven where leakage might occur. The characteristics of the liquid crystal material are chosen such that if leakage above a preset level does occur at any location around the edge of the door, the absorbing material generates heat resulting in a quickly noticeable colour change in the liquid crystal film.

In drawings which illustrate an embodiment of the invention,

Figure 1:
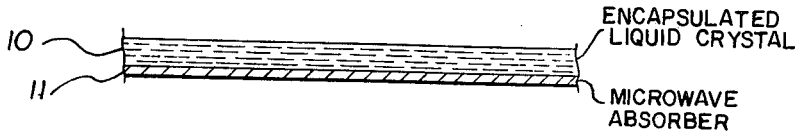
FIG. 1 is a cross section of a microwave leakage indicator strip.
Figure 2:
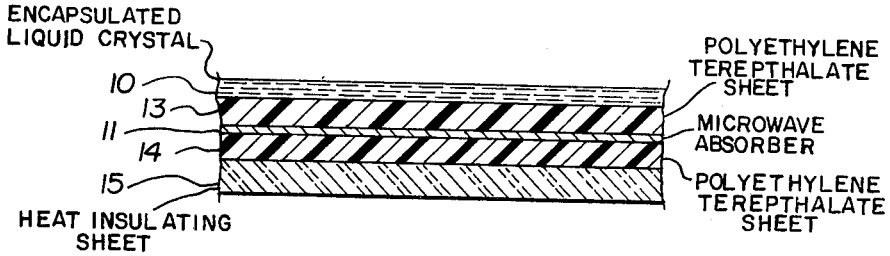
FIG. 2 is a cross section of a practial indicator strip.

Basic configuration of the microwave leakage indicator strip (MLIS) is shown in FIG. 1, which depicts an encapsulated liquid crystal (ELC) film 10 backed by a microwave absorbing material layer 11. Its operation is based upon the change in colour exhibited by an ELC film in a certain temperature range. In the preferred arrangement as shown in FIG. 2, a Mylar (Trademark for polyethylene terepthalate) sheet 13 covered by an ELC film 10 and then backed by a microwave absorbing material 11 coated on a second sheet of Mylar 14 is used. A sheet of heat insulating material 15 is also attached (conveniently by double sided sticky tape) to the strip. A coating of black ink is associated with the ELC film and provides a dark background which absorbs any light transmitted through the ELC and allows the selectively reflected light (determined by temperature) to be viewed without light interference. Outside the preferred temperature range, the ELC film is clear and only the dark background shows. In the temperature range of operation, the ELC film scatters the incident (ambient) light and exhibits whole spectrum of colours as the temperature changes. Blue colours are associated with warm temperature and the red colours with cooler temperatures. When the strip is exposed to microwaves, the microwave absorbing material 11 generates heat and the change in colour of the ELC film from black to blue indicates the presence of microwaves. The microwave power density at which this change in colour occurs is decided by the operating temperature of the ELC and the properties of the microwave absorbing material.

Figure 3:
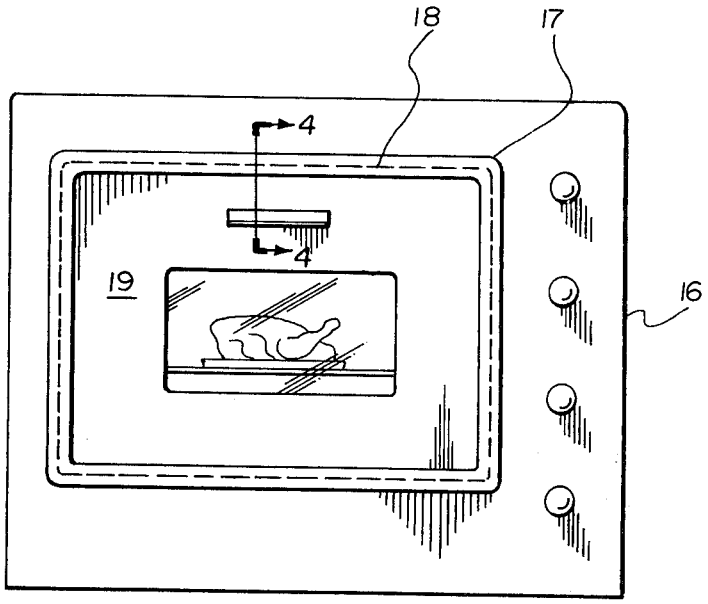
FIG. 3 is a view of a microwave oven with strip in place around door.
Figure 4:
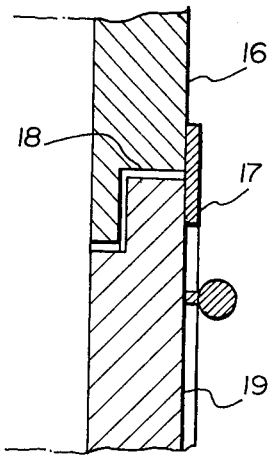
FIG. 4 is a transverse cross-section of an oven door with strip in place.

FIG. 3 is a microwave oven 16 with a microwave leakage indicator strip (MLIS) 17 around the sealing slot 18 of door 19. The strip 17 is preferably fixed to the edge of the door 19, overlapping the sealing slot 18 as shown in FIG. 4.

Various experiments have been conducted to evaluate the performance of MLIS for indication of leakage from a recent model of a microwave oven and a waveguide radiating slot. Efforts have been concentrated on indication of leakage beyond 1 mw/cm$^2$ and 5 mw/cm$^2$ (at a distance of 5 cm from the oven door). The former of these is the Canadian permissible level and the latter is the U.S. level for microwave ovens in use. The microwave absorbing coating was made from a mixture of absorbing pait and lacquer. The ratio of the two constituents and the thickness of the coating were varied to obrain MLIS's with various microwave leakage thresholds. The microwave absorbing material may also consist of a thin strip of commercially available foam like material used for reducing reflections. ELC film with temperature range of 45°-50° C was used. Preliminary experiments indicate negligible changes in microwave leakage thresholds with room temperature. The effect of hot vapours from the food being cooked has been minimized by putting a thin backing of thermal insulation on the MLIS.

Colour changes, which occur after the oven has been operating for several minutes may be ignored, as long exposure to hot vapours from food may give a defective indication. Direct exposure to sunlight should also be avoided, as the black coating will raise the temperature of the ELC film and make it respond at a lower microwave leakage level.

Figure 5:
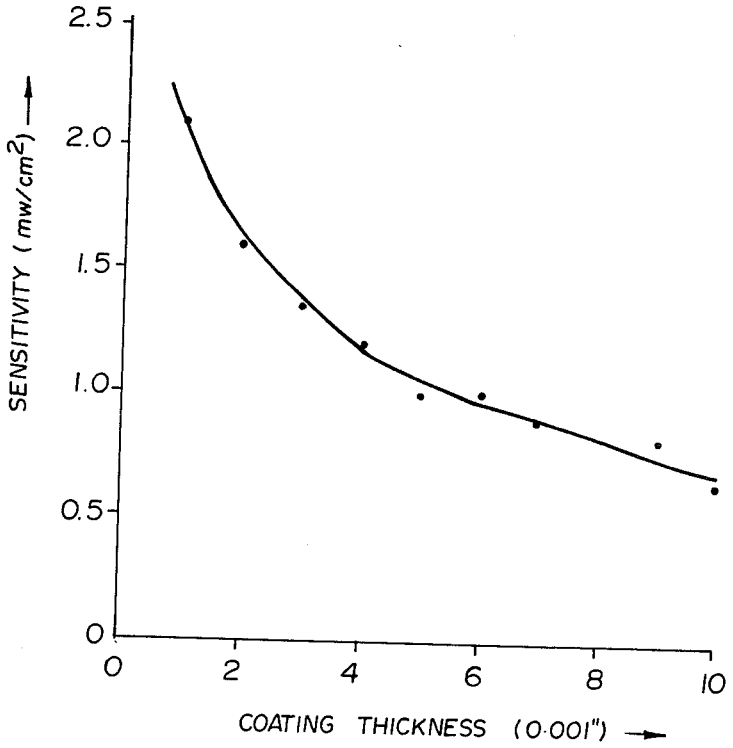
FIG. 5 is a graph of sensitivity of a typical strip in relation to coating thickness.

FIG. 5 is an experimental plot showing the sensitivity (power level to give significant colour change in $mw/cm^2$) in relation to coating thickness for a typical strip made from a mixture of 15% lacquer and 85% commercially available carbon-loaded lacquer.

Figure 6:
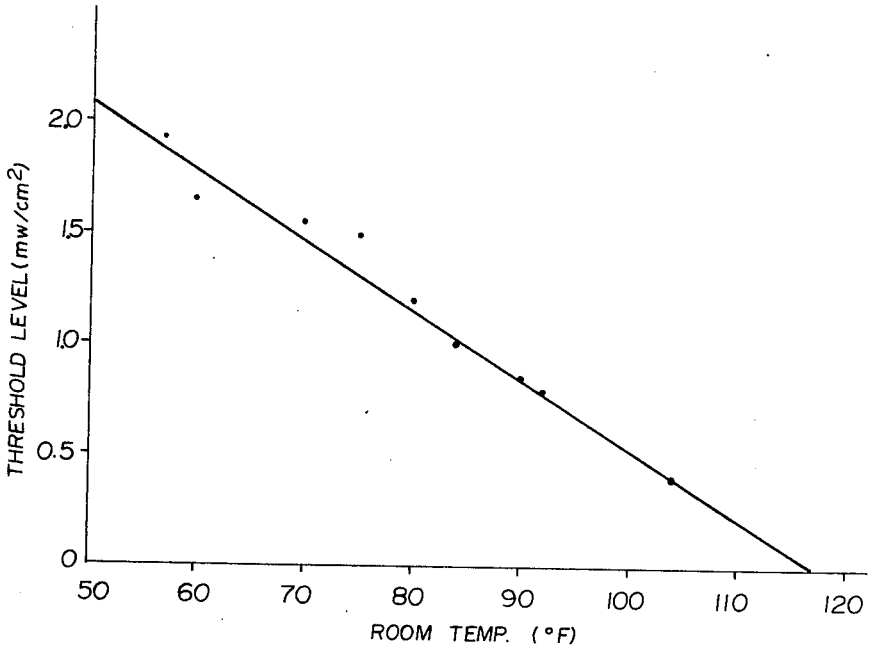
FIG. 6 is a graph of experimental results showing colour change threshold level in relation to room temperature.
Figure 7:
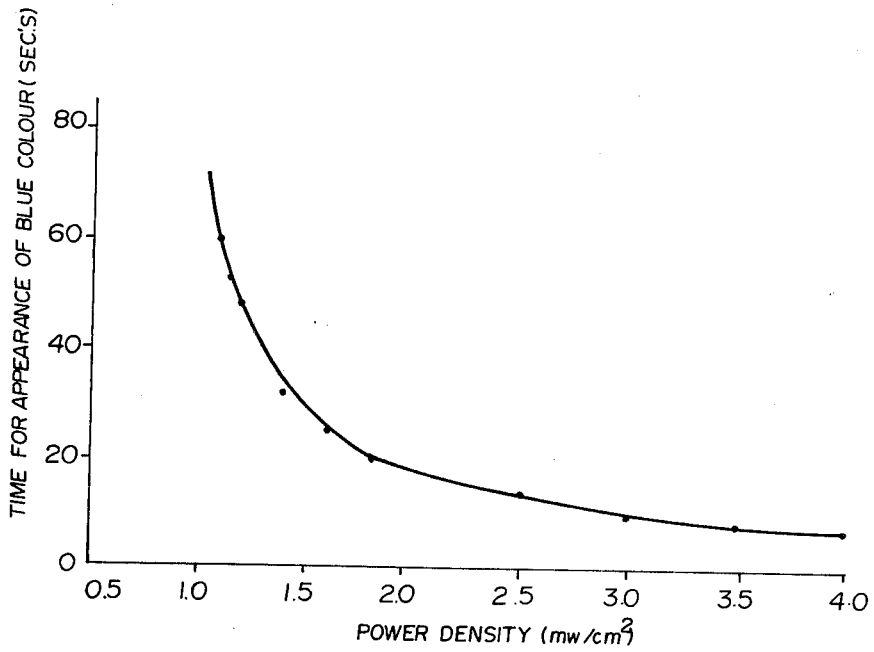
FIG. 7 is a graph showing time for colour change in relation to power densities.

FIG. 6 is a graph of experimental results showing effects of ambient temperature of the colour-change threshold and FIG. 7 is a graph of experimental results showing time required for colour appearance in relation to power density of leakage impinging on a typical strip.

Beside leakage indication, the MLIS may also be used for plotting areas of high field intensities in high power microwave appliators. Its sensitivity is changed by varying the coating thickness or ratio of the constituents of the microwave absorbing material as indicated earlier.

We claim:

1. A microwave leakage indicator comprising in combination with a microwave oven having a door defining a slot between the door and the oven where microwave leakage might occur, a strip of encapsulated liquid crystal film backed by a layer of microwave absorbing material mounted around the edge of the door overlapping the slot between door and oven, the film having the characteristics that if leakage above a preset level does occur at any location around the door the absorbing material generates heat resulting in a quickly noticeable color change in the liquid crystal film.

2. A microwave leakage indicator as in claim 1 wherein the strip is made up of a plastic sheet covered by the encapsulated liquid crystal film and backed by a layer of black ink.

3. A microwave leakage indicator as in claim 2 wherein the microwave absorbing material is made up a mixture of microwave absorbing paint and lacquer, the ratio of two the constituents and the thickness of coating being such as to obtain a predetermined microwave leakage threshold.

* * * * *